US009561898B2

(12) United States Patent
Love et al.

(10) Patent No.: US 9,561,898 B2
(45) Date of Patent: Feb. 7, 2017

(54) MARINE SIDE CURTAIN STOWAGE APPARATUS

(71) Applicants: David Love, Beaufort, NC (US); Martin Love, Beaufort, NC (US)

(72) Inventors: David Love, Beaufort, NC (US); Martin Love, Beaufort, NC (US)

( * ) Notice: Subject to any disclaimer, the term of this patent is extended or adjusted under 35 U.S.C. 154(b) by 0 days.

(21) Appl. No.: 14/461,882

(22) Filed: Aug. 18, 2014

(65) Prior Publication Data

US 2016/0046434 A1 Feb. 18, 2016

(51) Int. Cl.
*B65D 85/64* (2006.01)
*B65D 65/08* (2006.01)

(52) U.S. Cl.
CPC ..... *B65D 85/64* (2013.01); *B65D 65/08* (2013.01); *B65D 2585/649* (2013.01)

(58) Field of Classification Search
CPC ..... A45C 3/001; A45C 7/0095; A45C 11/00; A45C 13/02
USPC ..... 383/38–40; 206/326; 29/401.1
See application file for complete search history.

(56) References Cited

U.S. PATENT DOCUMENTS 1,333,246 A 3/1920 Coburn
1,398,885 A 11/1921 Aills
1,679,101 A * 7/1928 Sternthal ..... 206/553
4,466,374 A 8/1984 Katz
4,738,547 A * 4/1988 Brown ..... 383/39
5,139,143 A * 8/1992 Pond ..... 206/373
5,427,239 A * 6/1995 Hunt ..... 206/372
6,209,723 B1 * 4/2001 Fields ..... 206/373
6,406,183 B1 6/2002 Bober
6,598,653 B1 7/2003 Gonzalez
6,648,396 B2 11/2003 Monahan et al.
6,808,066 B2 * 10/2004 Bean ..... 206/349
7,980,761 B2 * 7/2011 Fultcher et al. ..... 383/4
8,642,870 B1 * 2/2014 Rosa ..... 84/453
2014/0090591 A1 4/2014 Shearer et al.

* cited by examiner

*Primary Examiner* — Peter Helvey
(74) *Attorney, Agent, or Firm* — Mark Taylor

(57) ABSTRACT

A marine side curtain stowage apparatus for stowing pliant marine side curtains in sheet form includes a pliant base layer having an outer weather surface and an inner surface, a pliant top layer formed from a nonabrasive material for abutting contact with the entire transparent portion of a side curtain, a first fastening element operatively associated with the base layer and the top layer for releasably joining the first side edge of the base layer with the first side edge of the top layer; and a second fastening element associated with the base layer and the top layer for releasably joining the second side edge of the base layer with the second side edge of the top layer.

15 Claims, 16 Drawing Sheets

MARINE SIDE CURTAIN STOWAGE APPARATUS

BACKGROUND OF THE INVENTION

The present invention relates broadly to stowage apparatus for marine equipment, and, more particularly, to an apparatus for stowing marine side curtains.

Among the various types of sporting power boats are boats that include a "center console". The center console power boats are used for fresh water and salt water fishing and are built to take rough offshore waters in pursuit of ocean fish. These boats vary in length from about 18 to about 48 feet and all include some form of upstanding center console located in approximately the center of the boat, providing an otherwise open deck for enhanced fisherman's access to the water while allowing the pilot to control the boat from the helm console along the boat's centerline.

It is common for such center console power boats to be open without a permanent sheltering structure, having instead a removable sheltering structure that can include a frame that supports a covering over the console. Such a skeletal frame can be made from aluminum rods that are interconnected and upstanding from the boat deck adjacent the console to support a cover or canopy which is typically opaque, and a plurality of side curtains. Side curtains can also include a windshield, side windows and a rear window and can cover any open area around the console with a series of panels.

Other open deck boats without a center console can use side curtains to protect a helmsman or others on the open boat deck. As in the manner of the console boat, the side curtains on the other boats are formed as panels that are detachably mounted to a skeletal frame, typically made from aluminum rods.

The side curtain panels are typically made from a vinyl sometimes called "isinglass" that maintains transparency even though the curtains are thick for transparent vinyl. In addition, other transparent material may be used. Further, the side curtains are pliant and therefore, in use, their surface is typically uneven which can result in distorted images. Accordingly, there is an interest in keeping the curtains as clean and flat as possible to maximize the ability of the curtain to provide undistorted throughvision. Side curtains are also subject to scuffing and scratching which can also detract from the clarity of viewing through the curtain.

Such side curtains are typically installed and removed based on the real-time needs of the boaters. Changing wind, sea or sun conditions can influence the decision of whether or not to install or remove side curtains—whether front, rear, sides or canopy—while the boat is in use and underway. Therefore, the side curtains need to be readily accessible for installation but also need to remain out of the way of the helmsman and fisherman on the boat. Therefore, there exists a need to stow the side curtains in a compact manner. There is also a need to stow the side curtains in a compact manner that further protects the side curtains from scuffing, scratching and other damage when not in use.

SUMMARY OF THE INVENTION

It is accordingly an object of the present invention to provide a marine side curtain stowage apparatus that will fully cover and protect the windows of one or more marine side curtains stowed in the apparatus.

It is another object of the present invention to provide such a marine side curtain stowage apparatus that can be manipulated into a form with less lateral displacement for more compact stowage.

A marine side curtain stowage apparatus for stowing pliant marine side curtains in sheet form, the side curtains having a transparent portion for throughvision, according to one preferred embodiment of the present invention includes a pliant base layer having an outer weather surface and an inner surface with the inner surface being formed from a nonabrasive material for abutting contact with the entire transparent portion of a side curtain and a pliant top layer formed from a nonabrasive material for abutting contact with the entire transparent portion of a side curtain. The base layer and the top layer each include a first side edge, a second side edge, a first end edge and a second end edge with the base layer and the top layer joined along respective first end edges.

The present invention further includes a first fastening element operatively associated with the base layer and the top layer for releasably joining the first side edge of the base layer with the first side edge of the top layer; and a second fastening element associated with the base layer and the top layer for releasably joining the second side edge of the base layer with the second side edge of the top layer.

The base layer and the top layer are thereby configured to selectively cover with abutting contact the entire transparent portion of a side curtain, sealable against weather along respective side edges thereof and pliant for rolling into a generally cylindrical configuration for stowage of marine side curtains.

According to a second preferred embodiment, the marine side curtain stowage apparatus further includes a pliant intermediate layer extending between the top layer and the bottom layer, the intermediate layer formed from a nonabrasive material and having a first inner surface and a second inner surface, wherein multiple marine side curtains can be stowed with one marine side curtain between the base layer and the intermediate layer and one marine side curtain between the top layer and the intermediate layer.

It is preferred that the marine side curtain stowage apparatus further includes a plurality of pliant intermediate layers extending between the top layer and the bottom layer, the intermediate layers being formed from a nonabrasive material and having an outer surface and an inner surface, wherein multiple marine side curtains can be stowed with one marine side curtain between the base layer and one of the plurality of intermediate layers, one marine side curtain between the top layer another of the plurality of intermediate layers and one marine side curtain between two of the plurality of intermediate layers.

Preferably, the base layer extends beyond the top layer defining an extended layer portion along the first side edge of the base layer, wherein the extended layer portion includes a flap having a first portion of the first fastening element attached thereto for being folded over the top layer and fastenable thereto using a second portion of the first fastening element. The first fastener element may be a hook-and-loop fastener.

It is preferred that a first portion of the hook-and-loop fastener extends uninterrupted along a full length of the first side edge of one of the base layer and the top layer, and the second portion of the hook-and-loop fastener extends uninterrupted along a full length of the first side edge of the other of the base layer and the top layer.

Preferably, the base layer extends beyond the top layer defining an extended layer portion along a second side edge of the base layer, wherein the extended layer portion includes a flap having a first portion of the second fastening element attached thereto for being folded over the top layer and fastenable thereto using a second portion of the second fastening element. The second fastener element may be a hook-and-loop fastener.

It is further preferred that a first portion of the hook-and-loop fastener extends uninterrupted along a full length of the second side edge of one of the base layer and the top layer, and the second portion of the hook-and-loop fastener extends uninterrupted along a full length of the second side edge of the other of the base layer and the top layer.

Preferably, the outer weather surface of the base layer includes a fastening arrangement for retaining the stowage apparatus in a rolled condition.

It is preferred that the fastening arrangement includes at least one strap attached to the outer weather surface, the strap having a first end and a second end, and a buckle arrangement with a first buckle element attached to a one strap end and a second buckle arrangement attached to a second strap end, wherein the first buckle element is selectively matable with the second buckle element when the stowage apparatus is in a rolled condition.

Preferentially, the base layer and the top layer are formed from a single continuous sheet folded to form the base layer and the top layer.

It is preferable that the nonabrasive material includes a contact surface for contact with the transparent portion of the window wherein the contact surface includes a plurality of indentations to resist adhesion of the transparent portion of the window and the nonabrasive material contact surface.

It is preferred that the base layer side edges are reinforced with a selvage configured for the stowage apparatus to stand upright when rolled while retaining the stowed window elements in a covered condition wherein relative movement between the transparent portion of the window and the nonabrasive material contact surface is prevented.

The present invention can be presented as a more detailed structure. There, a marine side curtain stowage apparatus for stowing pliant marine side curtains in sheet form, the side curtains having a transparent portion for throughvision, wherein the stowage apparatus includes a pliant base layer having an outer weather surface and an inner surface, the inner surface being formed from a nonabrasive material for abutting contact with the entire transparent portion of a side curtain; and a pliant top layer formed from a nonabrasive material for abutting contact with the entire transparent portion of a side curtain wherein the base layer and the top layer each include a first side edge, a second side edge, a first end edge and a second end edge with the base layer and the top layer joined along respective first end edges.

At least one pliant intermediate layer extends between the top layer and the bottom layer, the intermediate layer formed from a nonabrasive material and having an outer surface and an inner surface, wherein multiple marine side curtains can be stowed with one marine side curtain between the base layer and the intermediate layer and one marine side curtain between the top layer and the intermediate layer.

A first fastening element is operatively associated with the base layer and the top layer for releasably joining the first side edge of the base layer with the first side edge of the top layer; and a second fastening element associated with the base layer and the top layer for releasably joining the second side edge of the base layer with the second side edge of the top layer.

The base layer extends beyond the top layer defining an extended layer portion along at least one side edge of the base layer, wherein the extended layer portion includes a flap having the second fastening element attached thereto for being folded over the top layer and fastenable thereto using the first fastening element and the second fastening element.

The base layer and the top layer are thereby configured to selectively cover with abutting contact the entire transparent portion of a side curtain, sealable against weather along respective side edges thereof and pliant for rolling into a generally cylindrical configuration for stowage of marine side curtains.

In addition, the present invention resides in a method for stowing marine side curtains in sheet form, the side curtains having a transparent portion for throughvision. The method includes placing a side curtain having a front surface and a back surface on a pliant base layer having an outer weather surface and an inner surface, the inner surface being formed from a nonabrasive material for abutting contact with the entire transparent portion of a side curtain; and covering the side curtain with a pliant top layer formed from a nonabrasive material for abutting contact with the entire transparent portion of a side curtain wherein the base layer and the top layer each include a first side edge, a second side edge, a first end edge and a second end edge with the base layer and the top layer joined along respective first end edges; wherein the side curtain is abutted over its entire front surface and back surface with nonabrasive material.

The method further includes joining the first side edge of the base layer with the first side edge of the top layer using a first fastening element operatively associated with the base layer and the top layer; and joining the second side edge of the base layer with the second side edge of the top layer using a second fastening element associated with the base layer and the top layer.

The method continues with folding any portion of the side curtains extending from the second end over onto the top layer; folding, starting at the second end, a portion of the base layer over onto the top layer; and folding a second portion of the base layer onto the top layer with the first folded portion being tucked under the second folded portion to create a rolling effect. Continue folding portions of the base layer onto the top layer while tucking each previously folded layer under the folded portion until the second end approaches the first end and overlies a portion of the outer weather surface adjacent the first end. Finally, the method includes configuring the stowage apparatus to remain in a rolled condition by joining two buckle portions of a fastener, wherein each buckle portion is mounted to a strap fixed to the base layer.

Preferably, the method further includes standing the rolled stowage apparatus upright with one side resting on a support surface.

By the above, the present invention provides a marine side curtain stowage apparatus that is straightforward in operation, provides enhanced protection for transparent portions of the marine side curtain and may be rolled into a more compact configuration for less invasive stowage of marine side curtains than was heretofore known.

DESCRIPTION OF THE PREFERRED EMBODIMENT

Figure 1:
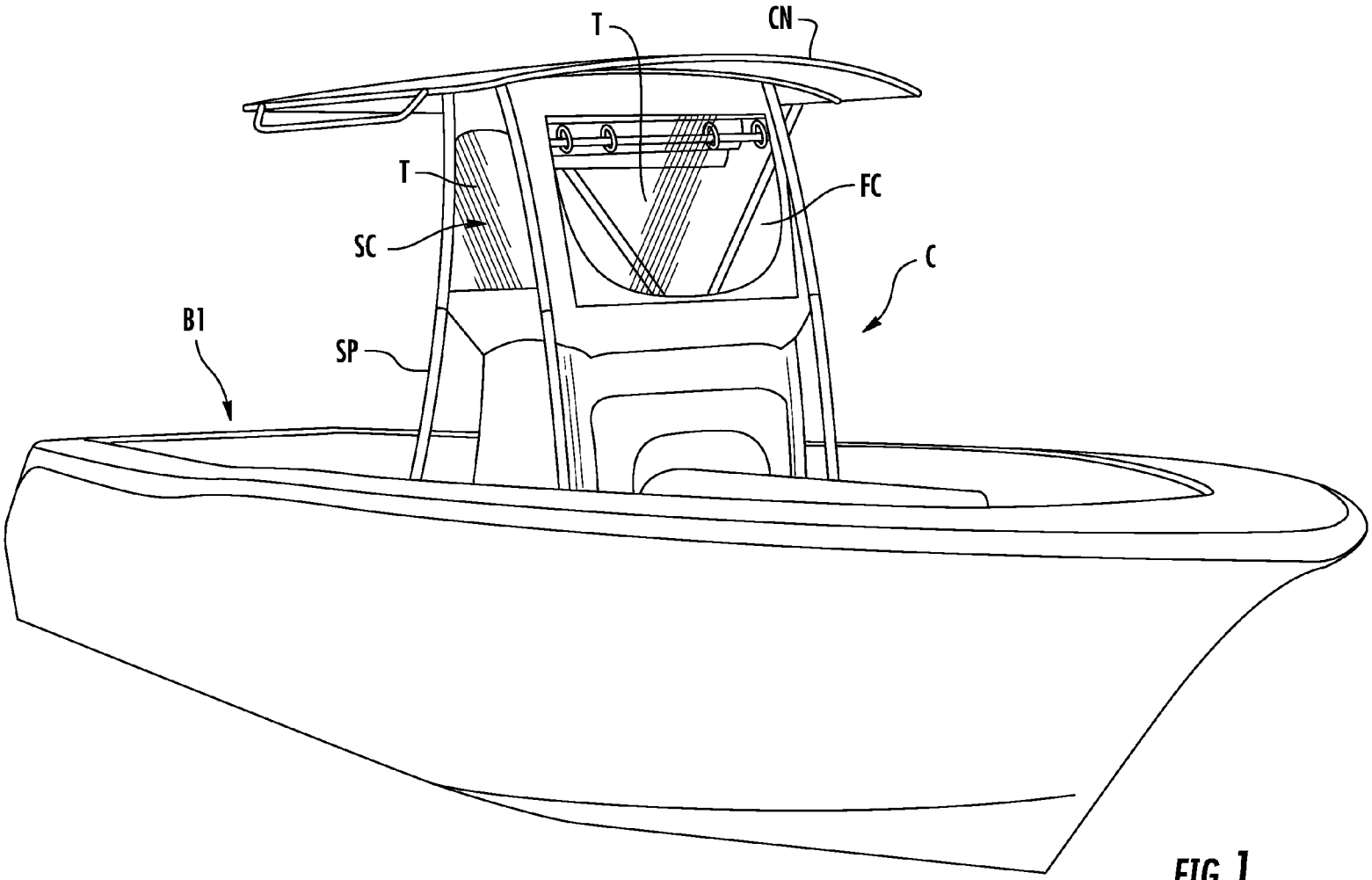
FIG. 1 is perspective view of marine vessel equipped with a center console and side curtains.

Turning now to the drawings and, more particularly to FIG. 1, a center console-type power boat is illustrated at B and includes an upstanding center console in approximately the center of the boat, providing an environment for a helmsman or pilot to control the boat and monitor its functions via instrumentation. Aluminum support poles SP forming a skeletal frame extend upwardly from the deck to a canopy CN which may or may not include a transparent portion T. Side curtains SC are attached to the support poles SP along the sides of the center console. The side curtains SC include a transparent surface T for throughvision. Additionally, a front curtain FC is attached forwardly of the helm and also includes a transparent portion T for through vision. On occasion, the users of the boat will remove one or more of the side curtains SC, front curtain FC, and canopy CN to allow an open console.

It should be noted that when discussing the present invention, the term "side curtain" is intended to include curtains on the sides of the frame, the front of the frame, the rear of the frame, and the canopy. All are suitable for use with the present invention, provided that all are pliant structures, preferably with transparent window portions. Curtains without transparent window portions can be accommodated by the present invention, but the full benefits of the present invention are achieved when stowing curtains with transparent window portions.

Figure 2:
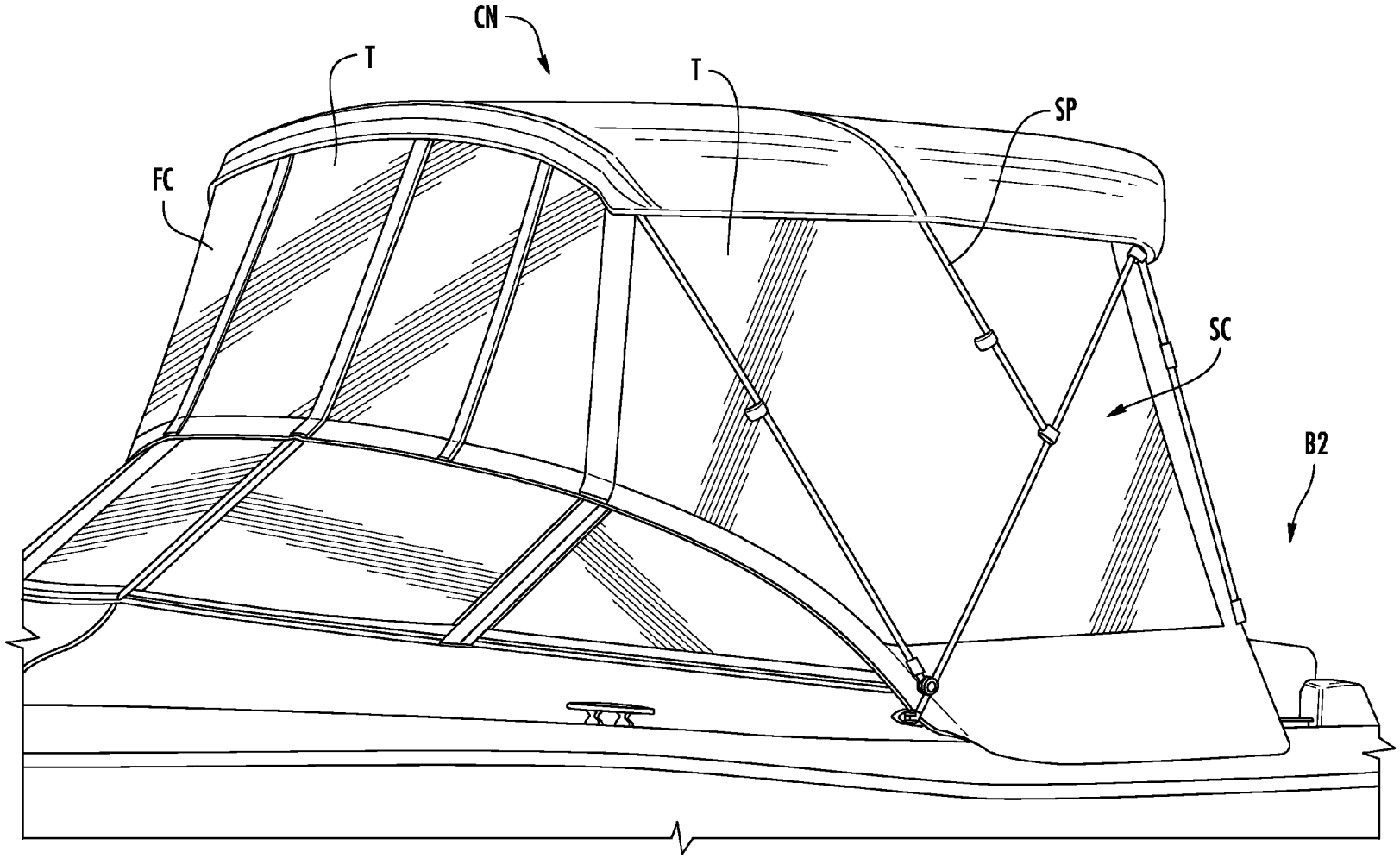
FIG. 2 is a side perspective view of a portion of a marine vessel without a center console and having side curtains.

Turning now to FIG. 2, a portion of a power boat that is not a console boat is illustrated at B2 and also includes an upstanding frame structure made from aluminum support poles SP. While configured differently in order to cover a larger portion of the vessel, the support frame also supports side curtains SC, front curtains FC, and a canopy CN. Any one or all of these structures may include transparent surfaces T forming windows for throughvision and are capable of use with the present invention.

Overall, pliant side curtains having window portions can be used on a variety of different power boats and other water craft, and could have any one of several different configurations. The basic commonality among all the side curtains is the pliant nature of the structure and the appearance of pliant window portions for throughvision. As discussed above, it may become necessary or desirable for boaters to remove and stow the side curtains in a straightforward, compact manner protective of the side curtains.

Figure 3:
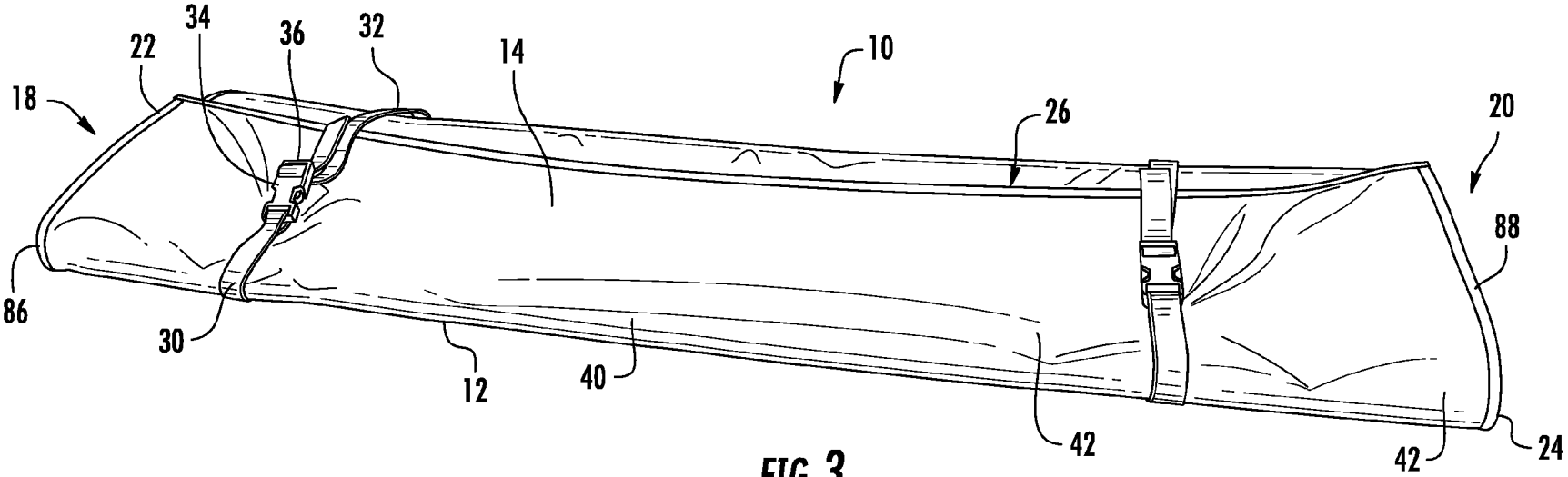
FIG. 3 is a perspective view of a marine side curtain stowage apparatus according to the present invention.

FIG. 3 illustrates a marine curtain stowage apparatus according to the present invention generally at 10 that includes, when folded or rolled for stowage itself, an elongate body 12. The body 12 includes a base layer 40 having an outer weather surface 42 that may be made of canvas or other such material and may or may not be water resistant or waterproof.

The base layer 40 includes a first end 14, a second end 16 and two sides 18, 20 having two side edges 22, 24. Each side edge 22, 24 of the base layer 40 has a selvage 86, 88 stitched the full length thereof and formed of durable material which may or may not be water resistant or waterproof, although benefits may be had for using water resistant or waterproof material.

A first strap 30 is attached to the base layer 40 near the first side 18 thereof. A second strap 32 is attached in opposition to the first strap 30 such that the straps meet adjacent the end 14 of the base layer 40. Each strap 30, 32 includes a respective buckle portion 34, 36 for mating and selectively holding the strap ends together in order to retain the stowage apparatus 10 in a folded or rolled condition for stowage with side curtains inside. It should be noted that the strap 30, 32 may be individual straps or may be one long strap that extends circumferentially about the stowage apparatus 10. A similar strap and buckle arrangement is fitted near the second side 20 of the base layer 40.

In this manner, side curtains can be stowed in a protective, compact manner. As will be seen, the pliant, planer layers of the stowage apparatus may be folded, rolled or both into the compact form seen in FIG. 3.

Figure 4:
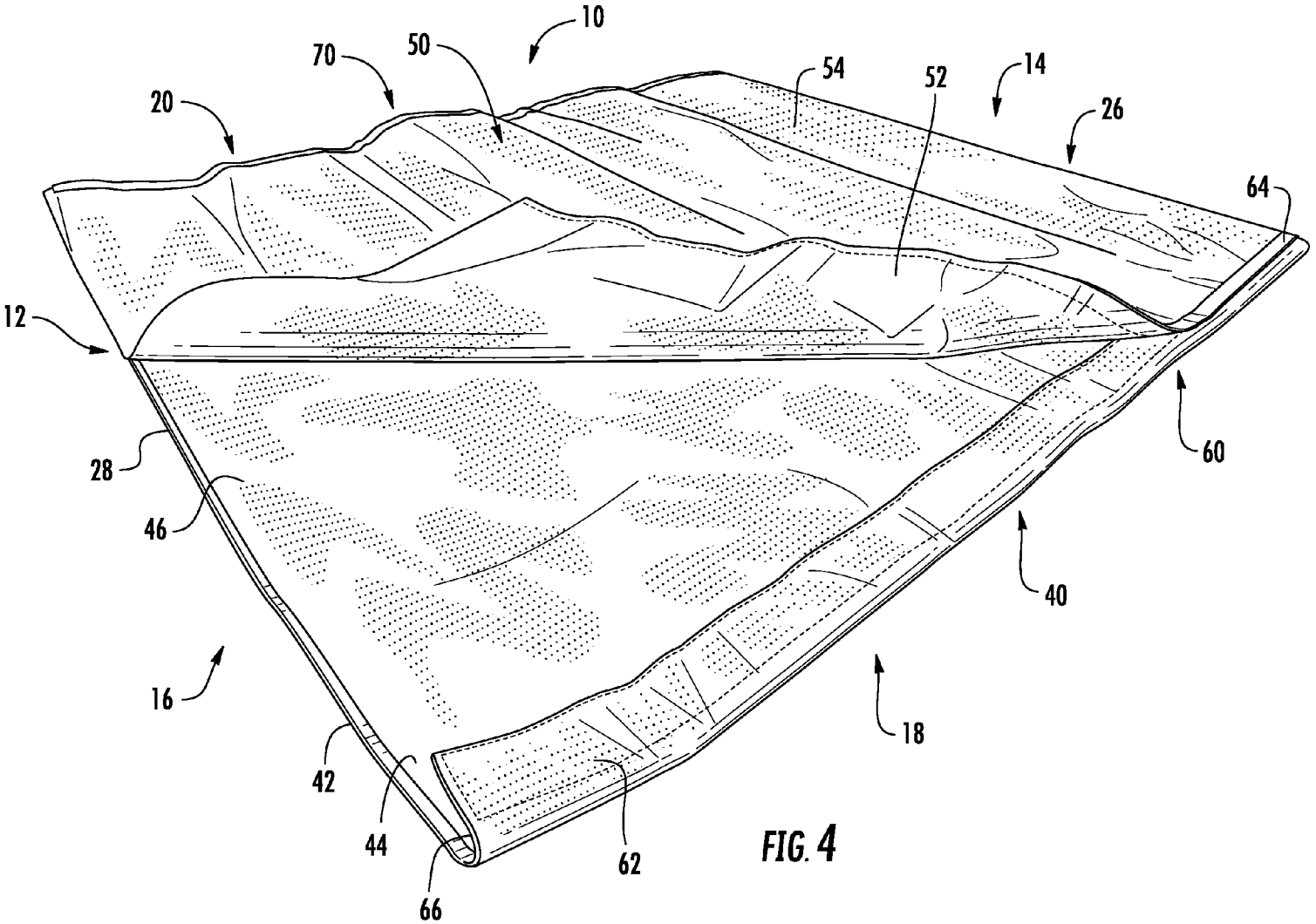
FIG. 4 is a perspective view of the marine side curtain stowage apparatus according to one preferred embodiment thereof.

Turning now to FIG. 4, a first preferred embodiment of the present invention is illustrated generally at 10 and includes the base layer 40 formed as a generally rectangular pliant planar sheet and a top layer 50, also formed as a generally rectangular pliant planar sheet. As seen in the unfolded condition, the body 12 includes a closed first end 14, an open second end 16, a first side 18 and a second side 20. The first end 14 includes a first end edge 26 and the second end 16 includes a second end edge 28. The first side 18 includes a first side edge 22 and the second side 20 includes a second side edge 24. It should be noted that, for clarity, reference numerals designating the sides, ends and edges apply to all layers and the body.

The base layer 40 is formed from two separate materials stitched or bonded together in some manner including the outer weather surface 42 as previously mentioned and an inner surface 44 formed from a non-abrasive material for contact with the side curtains when stowed. The base layer inner surface 44 includes a plurality of indentations 46 such that while the material forming the base layer inner surface 44 covers the side curtain over its entire transparent surface, individual portions of the base layer inner surface 44 are raised from the transparent material at the indentations 46 thereby forming small air pockets. The indentations 46 and the breathability of the material help prevent the inner surface, and as will be seen all like surfaces, from adhering to the vinyl transparent material of the side curtains. The preferred material is a 100 percent polypropylene sheet sold under the trademark BLOCK-IT® which is a registered trademark of Kimberly Clark Worldwide, Inc. The BLOCK-IT® matrix material is a fabric that is water repellent and breathable, as well as UV, mildew and rot resistant.

While the base layer inner surface 44 and the base layer outer surface 42 are formed from two different materials, the top layer 50 includes a top layer inner surface 52 and a top layer outer surface 54, both of which are formed from a single sheet of the polypropylene material that forms the base layer inner surface 44.

When forming the base layer 40 and the top layer 50, the top layer 50 can be an extension of the material forming the base layer inner surface 44 or it can be a separate sheet of material stitched or otherwise attached to the base layer 40. Either way, the top layer 50 is a generally rectangular pliant planar sheet that is the same dimension end to end as the base layer 40 and is slightly narrower along the sides 18, 20 than the base layer 40.

It should also be noted that when not in use, the best way to stow the present stowage apparatus is open and flat with the top layer 50 facing upwardly.

Figure 5:
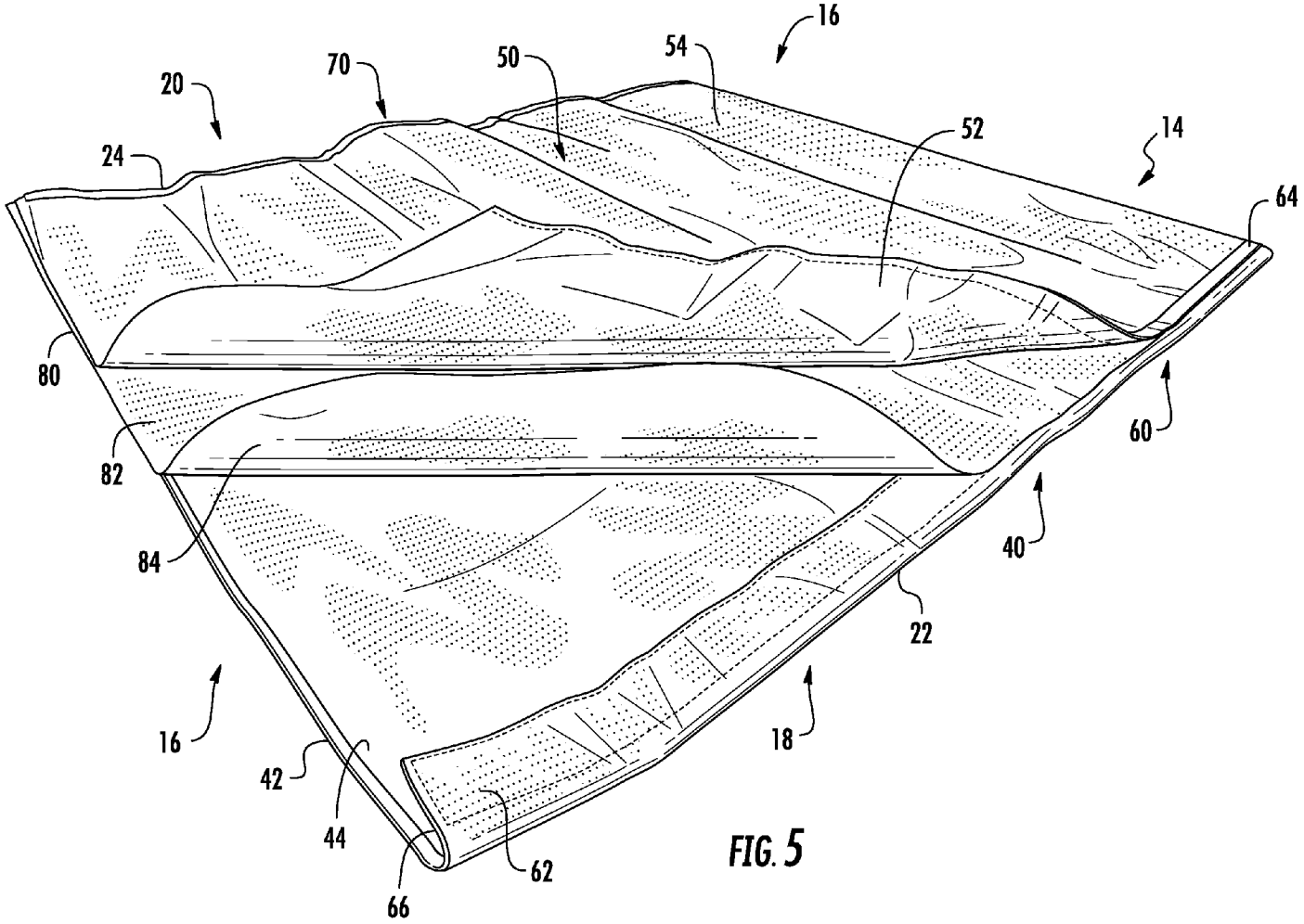
FIG. 5 is a perspective view of a marine side curtain stowage apparatus according to a second preferred embodiment of the present invention.

Turning now to FIG. 5, a second preferred embodiment of the present invention is illustrated in a manner similar to the embodiment illustrated in FIG. 4. As seen in FIG. 5, an intermediate layer 80 is formed as a generally rectangular pliant planar sheet including a first intermediate inner surface 82 and a second intermediate inner surface 84 on the opposite side of the first intermediate layer inner surface 82. Both surfaces of the intermediate layer 80 are referred to as inner surfaces because the intermediate layer 80 extends between the base layer 40 and the outer layer 50 such that, until used, the first intermediate layer inner surface 82 is in abutment with the top layer inner surface 52 and the second intermediate layer inner surface 84 is in abutment with the base layer inner surface 44. Therefore, the intermediate layer 80 remains internal to the structure defined by the base layer 40 and top layer 50. The intermediate layer 80 is joined to the base layer 40 and the top layer 50 at the first end 14 of the body 12. Accordingly, the top layer 50 and the intermediate layer 80 may be folded away from the base layer 40 like pages in a book as illustrated in FIG. 4 and FIG. 5. It should be noted that additional intermediate layers may be used, although as the number of layers and stowed side curtains increases, the difficulty of rolling the layers also increases.

The junction of the base layer 40 and the top layer 50 at the first end 14 provides no external access to the region between the layers 40, 50. When the present apparatus 10 is rolled, the resultant open second end 16 will be within the folds of the stowage apparatus as seen in FIG. 3 and as will be seen in greater detail hereafter. The remaining sides, 18, 20 are sealed from the weather by a first fastening element 60 along the first side 18 and a second fastening element 70 along the second side 20.

As best seen in FIG. 5, the first fastening element 60 includes a pliant flap 62 extending outwardly from the base layer 40 along the full extent of the first side edge 22. As will be seen hereinafter, the flap 62 is movable from an open position wherein the top layer 50 and the intermediate layer 80, if provided, may rest against the base layer 40, and an overlying position where the flap 62 extends partially over the exposed top layer 50. If the intermediate layer is present, the first side 18 of the intermediate layer 80 extends between the base layer 40 and the top layer 50 with the flap 62 overlying the aforesaid portion of the layer 50. Although not fully illustrated in FIG. 5, the second fastening element 70 is formed basically like the first fastening element 60, including a second flap 72 extending the full length of the second side edge 24.

In order to retain the flaps 62, 72 in position against the top layer 50, a two portion hook-and-loop fastener is provided. The hook-and-loop fastener may be VELCRO®. VELCRO® is a registered trademark of Velcro Industries, B.V. The first portion of the hook-and-loop fastener 64 extends the full length of the first side edge 22 and is attached to the top layer 50. The second portion of the hook-and-loop fastener portion 62 extends on the underside of the first flap 62 for the full length of the flap for mating engagement with the first hook-and-loop portion 64.

It should be noted that it makes no difference whether the hook portion is considered the first or second portion of the hook-and-loop fastener or the loop portion is considered the first or second portion of the hook-and-loop fastener, so long as there is one of each. Although not illustrated in FIG. 5, the second fastening element 70 includes a first portion of the hook-and-loop fastener 74 extending along the full length of the second side edge 24 and the remaining portion of the hook-and-loop fastener 76 extends along the underside of the second flap 72. While it is preferential to extend the hook-and-loop fasteners along the full length of the respective side edges 22, 24, it should be understood that the hook-and-loop fastener portions may be distributed in segments along the length in a manner configured for mating engagement with one another. Whatever variances may exist between the first fastening element 60 and the second fastening element 70, the structures of the fastening elements the base layer 40 and the top layer 50 should each be sufficient to retain the respective flaps 62, 72 against the base layer 50, thus closing the sides 18, 20 of the body 12 of the present stowage apparatus.

Figure 6:
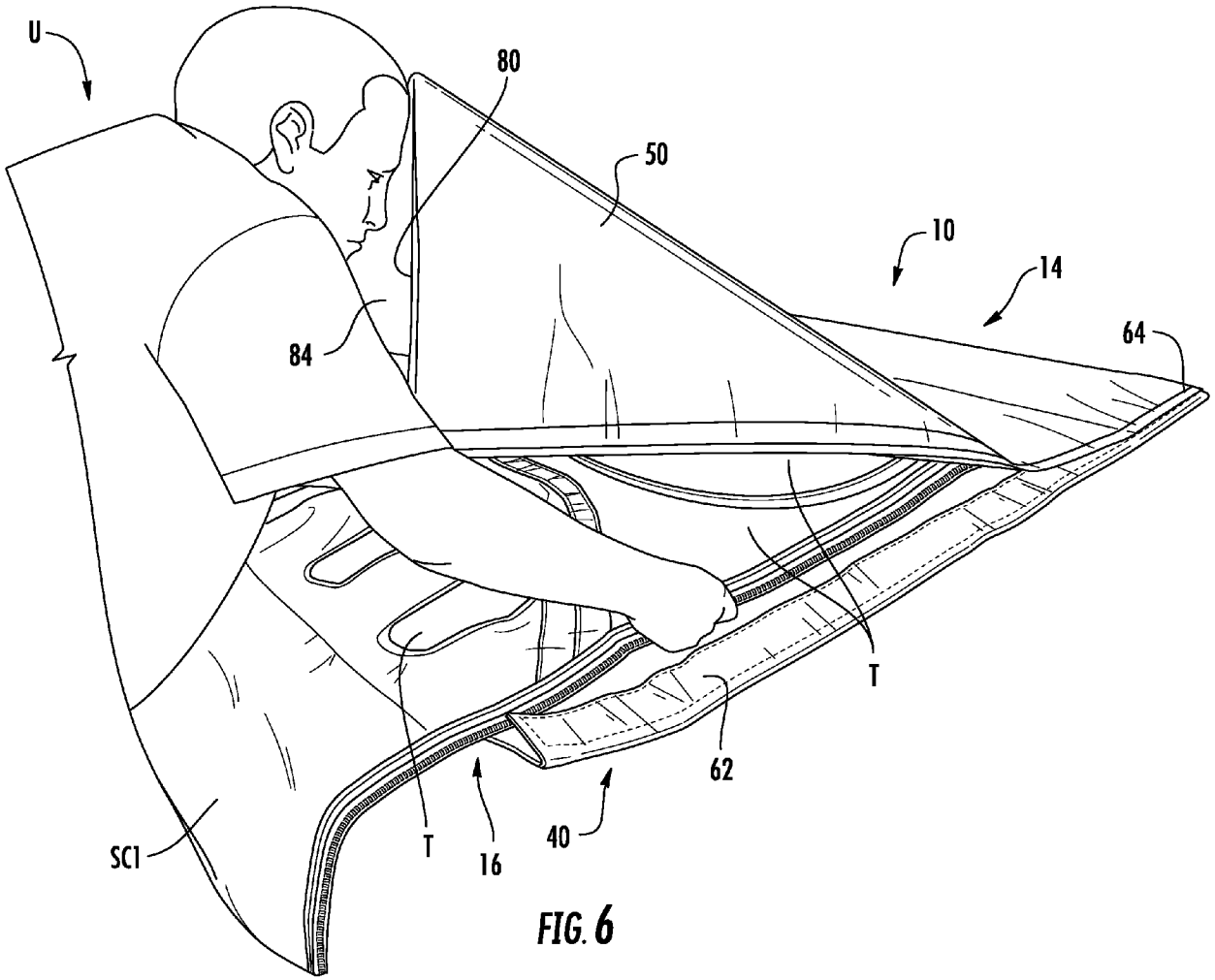
FIG. 6 is a perspective view of the second preferred embodiment of the present invention used according to a method step.

Turning now to FIGS. 6-16 with initial emphasis on FIG. 6, the method of stowing marine side curtains according to the present invention will be described. As seen in FIG. 6, a user U takes a pliant first marine side curtain SC1 having transparent window portions T and inserts it between the base layer 40 and the intermediate layer 80 with the top layer 50 overlying the intermediate layer. In FIG. 6, the user U is using a marine side curtain stowage apparatus according to the second preferred embodiment of the present invention, i.e., having the intermediate layer 80. The user U ensures that the side curtain SC1 is laid flat on the base layer 40 and then the intermediate layer 80 is extended over the remaining surface of the first side curtain SC1 with the base layer inner surface 44 and the first inner surface of the immediate layer 82 fully covering the transparent surfaces T of the side curtain SC1.

If necessary, the side curtain SC1 is inserted in the stowage apparatus all the way to the first end 14 with a non-windowed portion extending beyond the open end of 16 of the apparatus 10. It should be noted that the side curtains can vary in size and length which can, to a reasonable extent, be accommodated by the present stowage apparatus. In addition, the present stowage apparatus can be made in virtually any size to accept virtually any size side curtains and provide complete coverage of the transparent window portions thereof.

Figure 7:
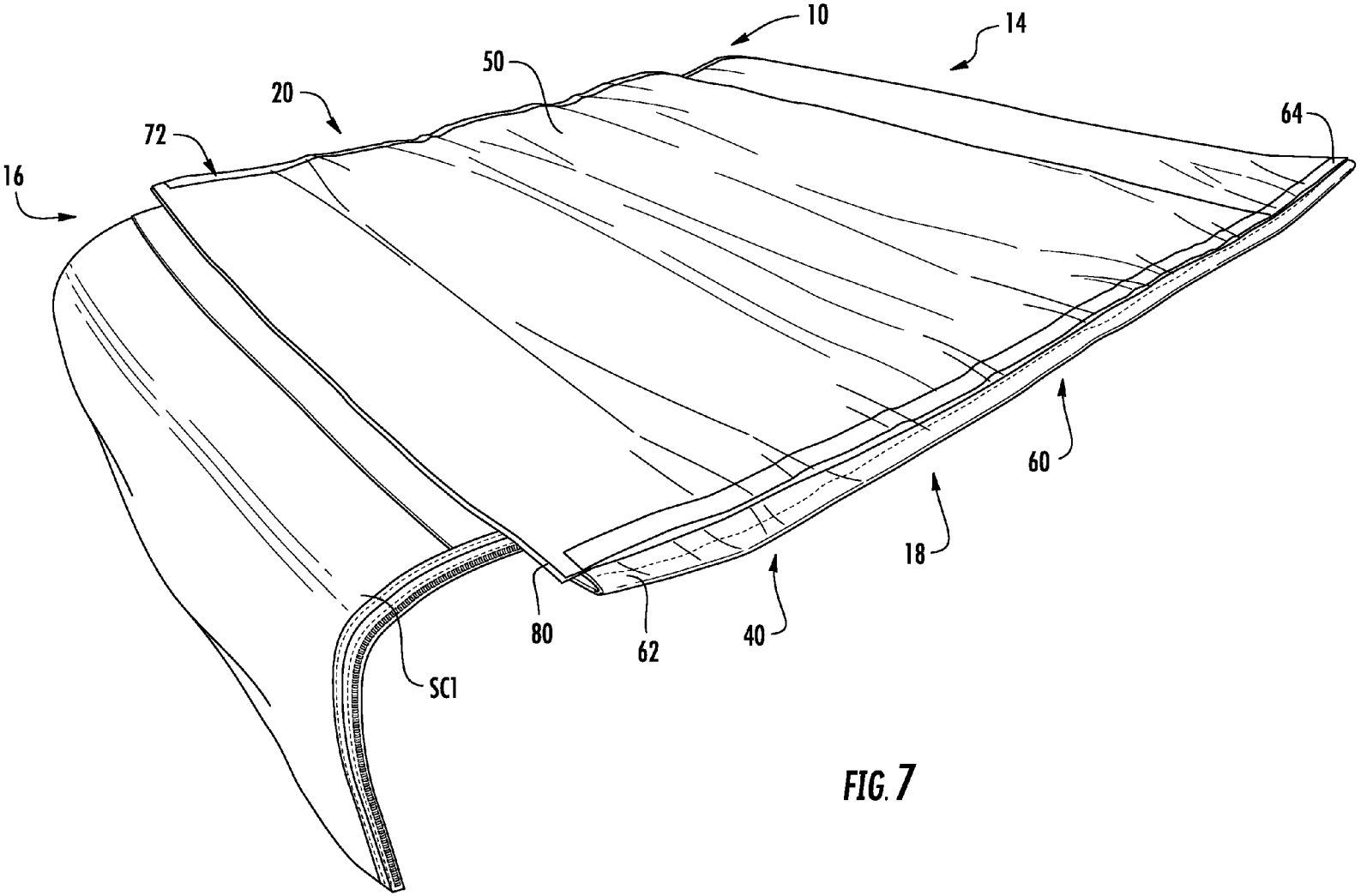
FIG. 7 is a perspective view of stowage apparatus illustrated in FIG. 6 according to another method step.

Turning now to FIG. 7, and continuing with the method, once the first side curtain SC1 is in place, the intermediate layer 80, with the top layer 50 overlying the intermediate layer 80, is extended flat over the base layer 40. Notably, the flaps 62, 72 remain under the intermediate layer 80 and the top layer 50 and will do so until needed.

Figure 8:
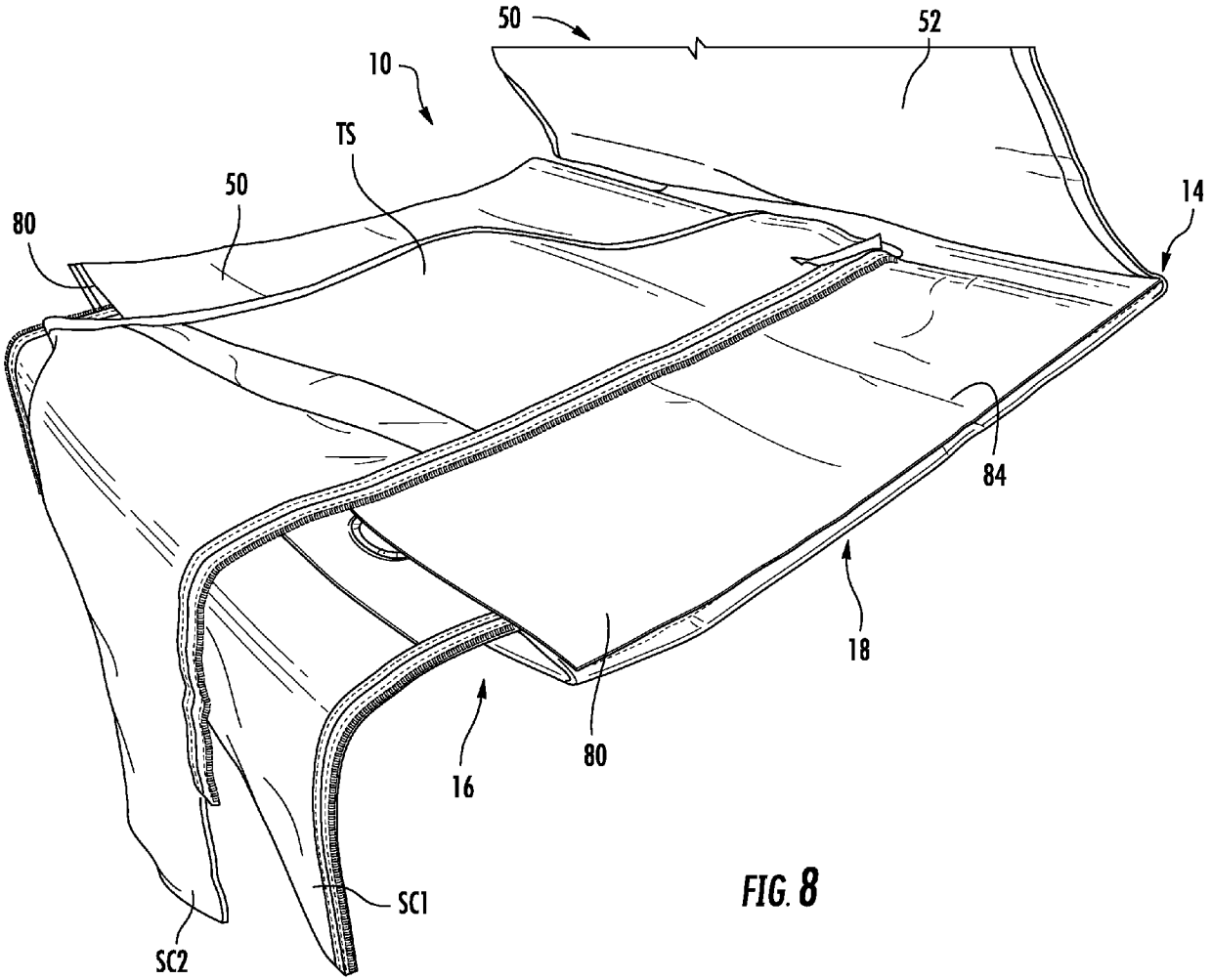
FIG. 8 is a perspective view of stowage apparatus illustrated in FIG. 6 according to another method step.

Turning now to FIG. 8, the top layer 50 is raised sufficiently to allow the second side curtain SC2 to be laid on the second inner surface 84 of the intermediate layer 80 and stretched thereacross with the transparent surface T of the second side curtain SC2 laid flat over the second inner surface 84 of the intermediate layer 80. A portion of the first side curtain SC1 and the second side curtain SC2 may extend beyond the open end 16 of the stowage apparatus 10 which will be attended to later in the process.

Preferably, the pliant apparatus is loaded with side curtains while resting on a support surface which is not shown in the present case for clarity. In the present case, the support surface is a table from which the extended portions of the first side curtain SC1 and the second side curtain SC2 are hanging, thereby giving the biplaner image of the side curtains SC1, SC2 as seen in FIGS. 8 and 9.

Figure 9:
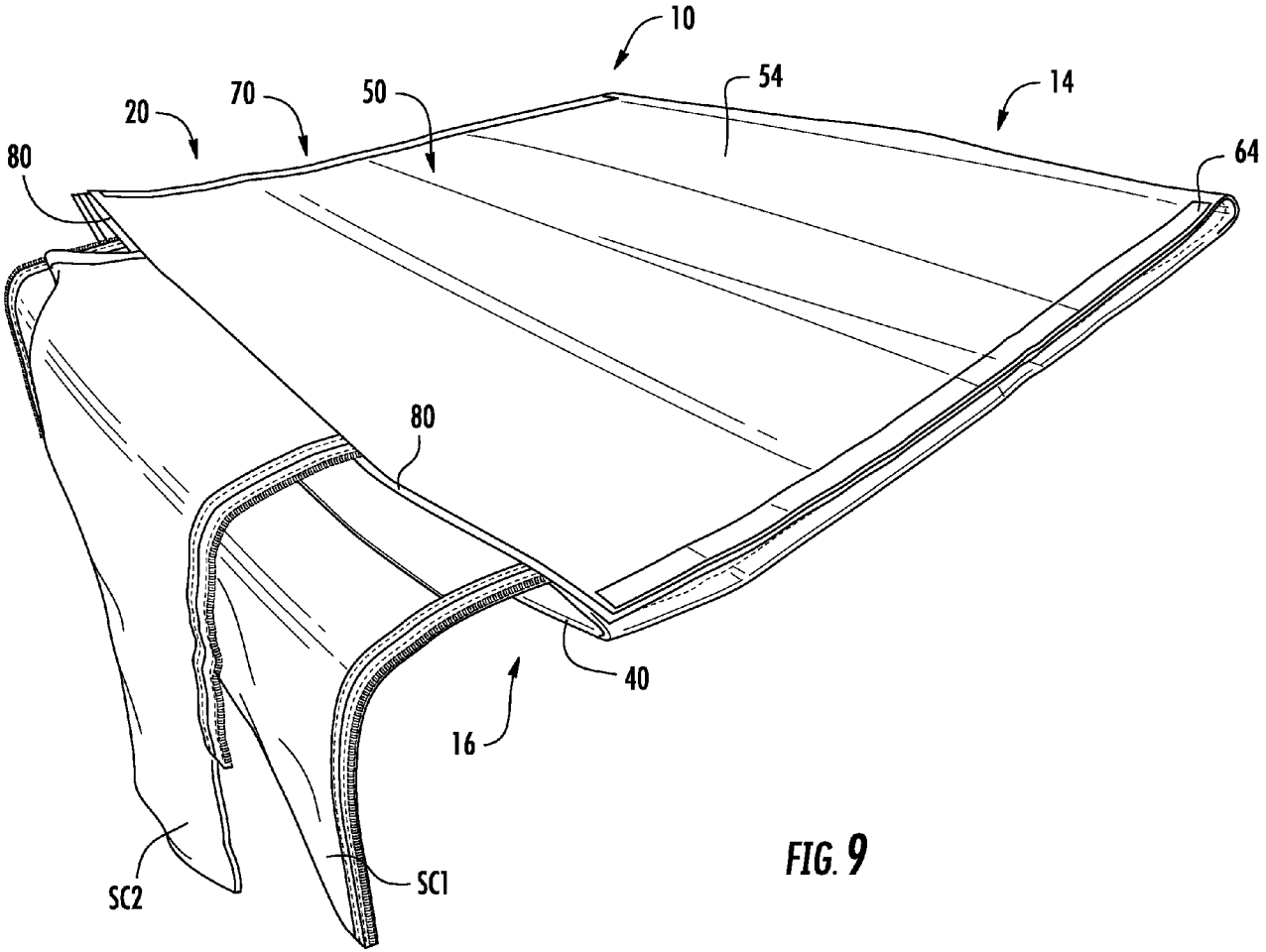
FIG. 9 is a perspective view of stowage apparatus illustrated in FIG. 6 according to another method step.

Turning now to FIG. 9, the top layer 50 is extended over the intermediate layer 80 and the second side curtain SC2 to extend flat over the transparent portions of the second side curtain SC2. At this time, all transparent portions T of the side curtains SC2 are abutted over their entire respective surfaces by the non-abrasive material of the inner surfaces of the base layer 40, intermediate layer 80 and top layer 50.

Figure 10:
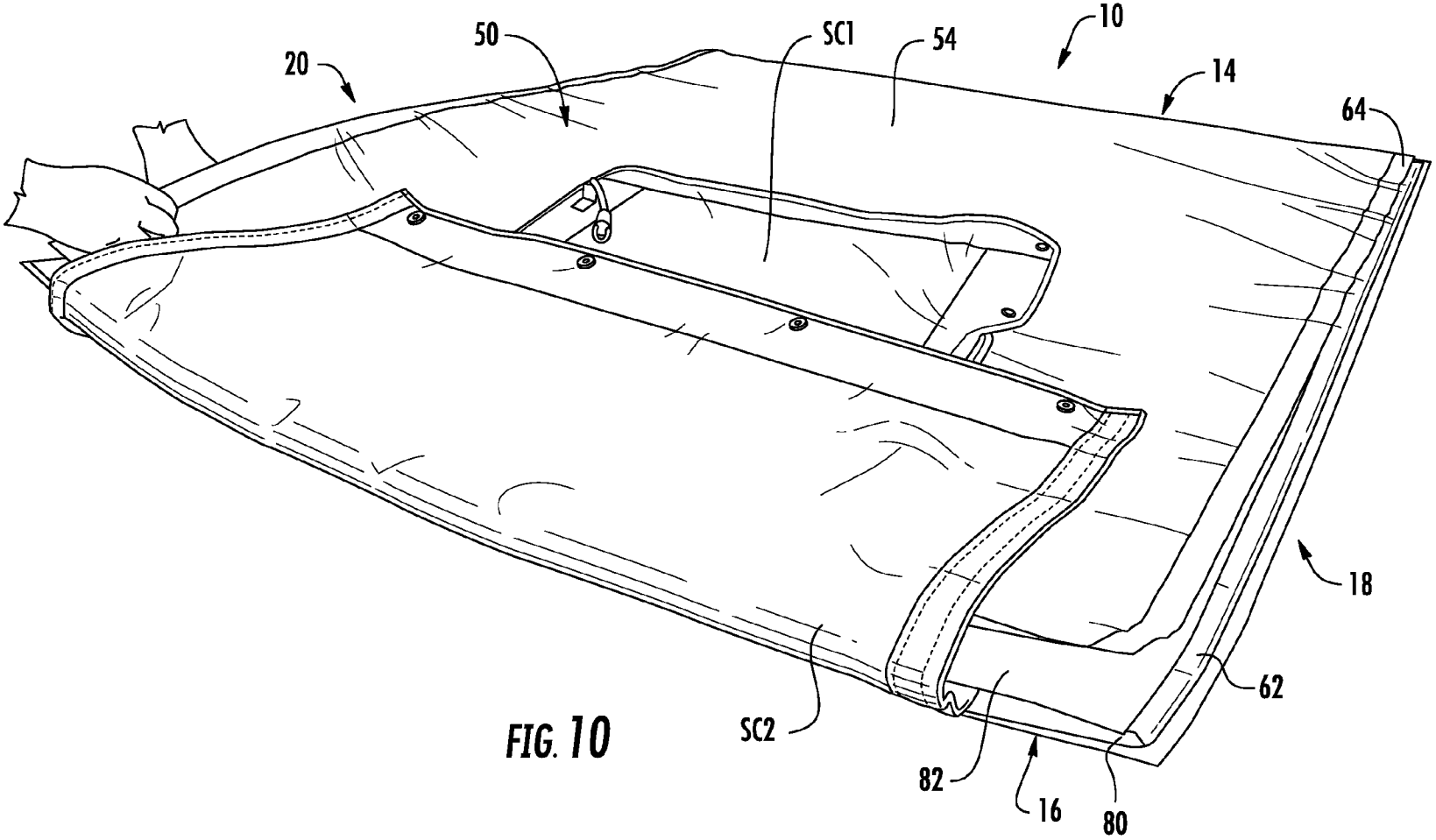
FIG. 10 is a perspective view of stowage apparatus illustrated in FIG. 6 according to another method step.

As seen in FIG. 10, the extended portions of the side curtains SC1, SC2 are folded over onto the outer surface 54 of the top layer 50.

Figure 11:
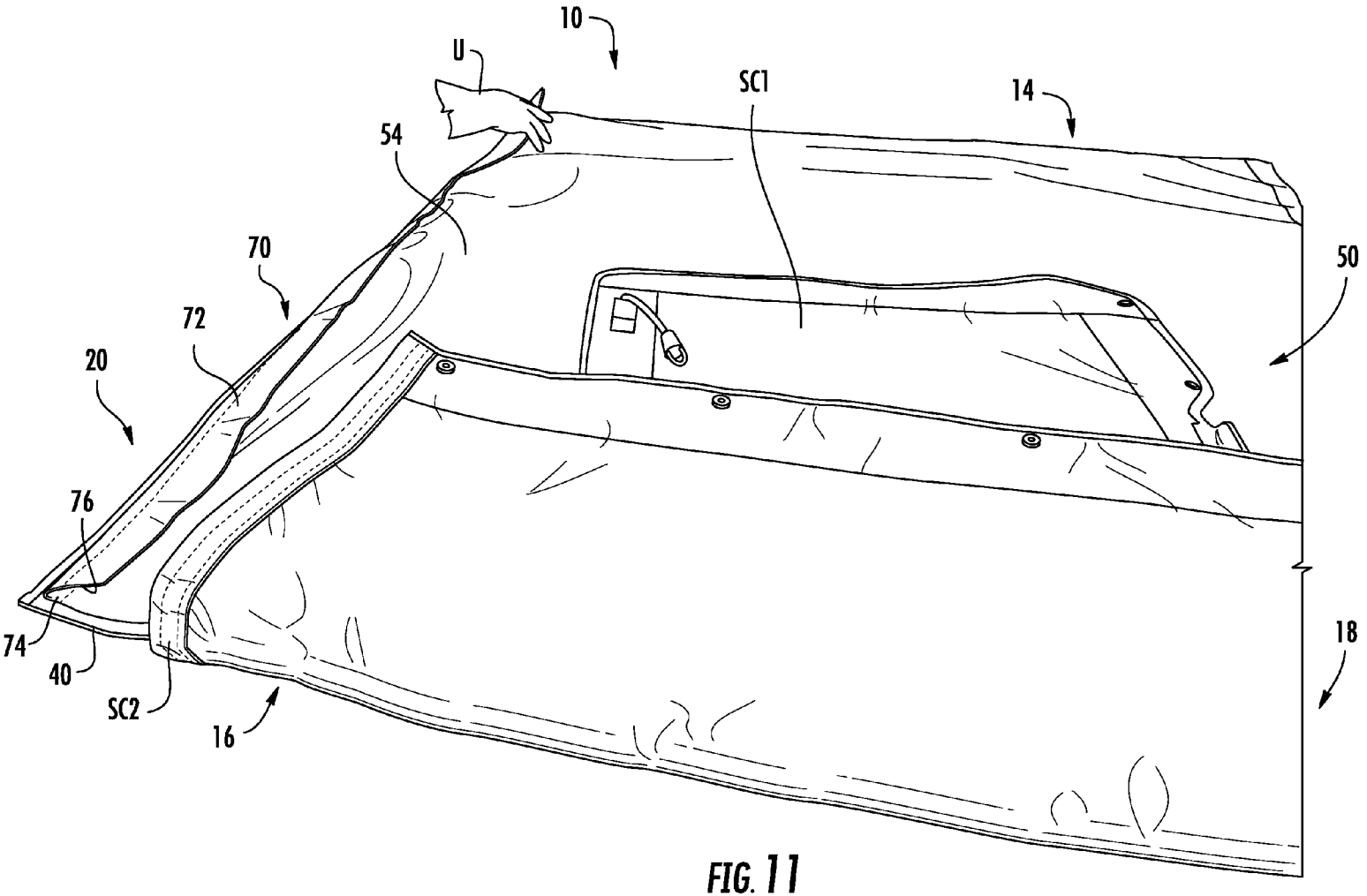
FIG. 11 is a perspective view of stowage apparatus illustrated in FIG. 6 according to another method step.

According to the method, the next steps include sealing the side portions against the elements. Turning to FIG. 11, the user U extends the second flap 72 from under the top layer 50 and intermediate layer 80 outwardly and then into an overlying position with a portion of the side 20 of the top layer 50 such that the second hook-and-loop fastener portions 74, 76 are mated, thereby retaining the flap 72 against the top layer 50 and thus closing the second fasting element 70. The process is repeated on the first side 18 for the first fastening element 60.

With the first fasting element 60 and the second fasting element 70 holding the sides in a closed position, the folding or rolling can begin.

Figure 12:
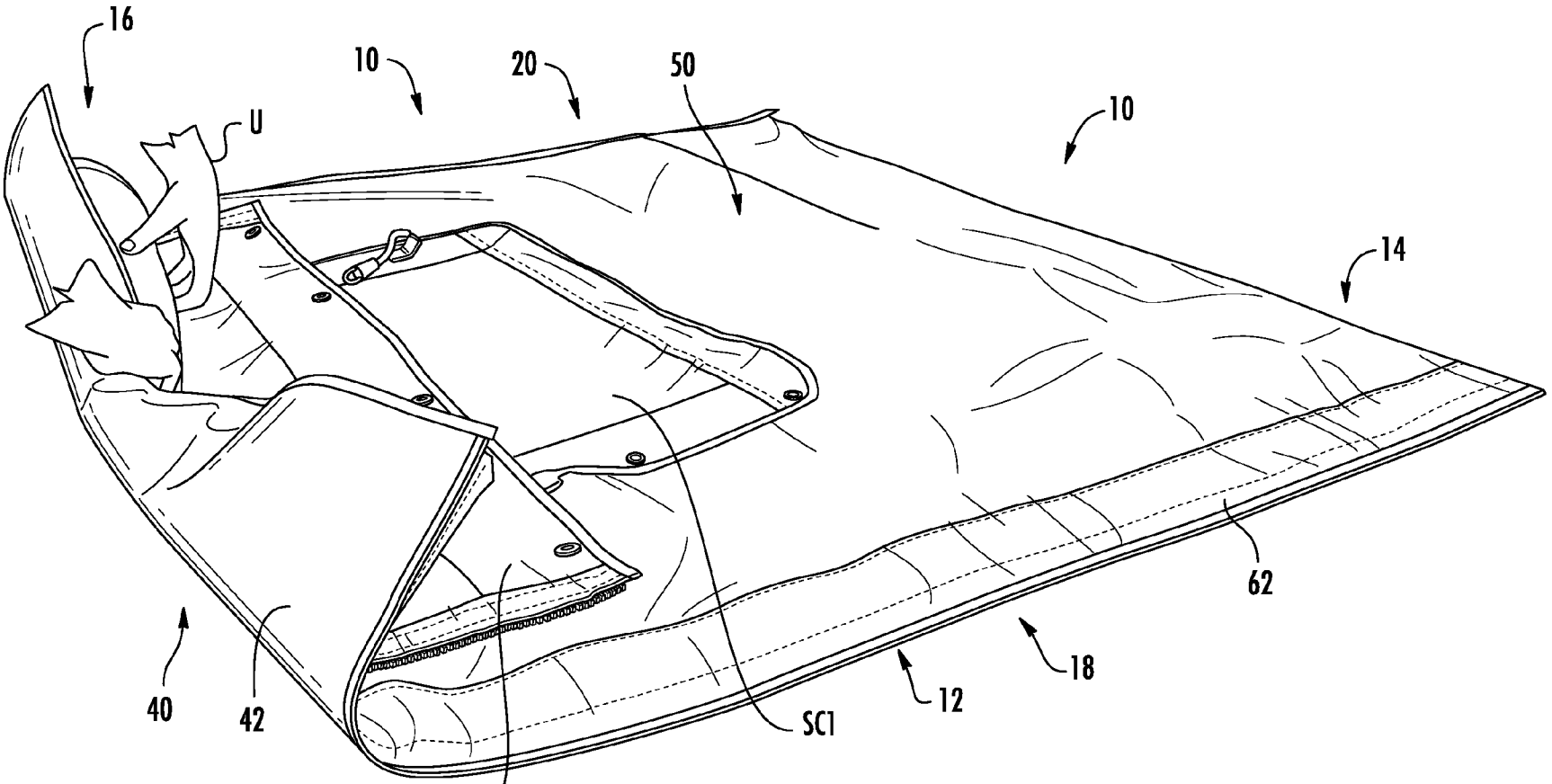
FIG. 12 is a perspective view of stowage apparatus illustrated in FIG. 6 according to another method step.

Turning now to FIG. 12, the user U grips the second end 16 and folds a portion of the second end 16 over onto the remaining portion of the body 12 and the extended portions of the first side curtain SC1 and the second side curtain SC2.

Figure 13:
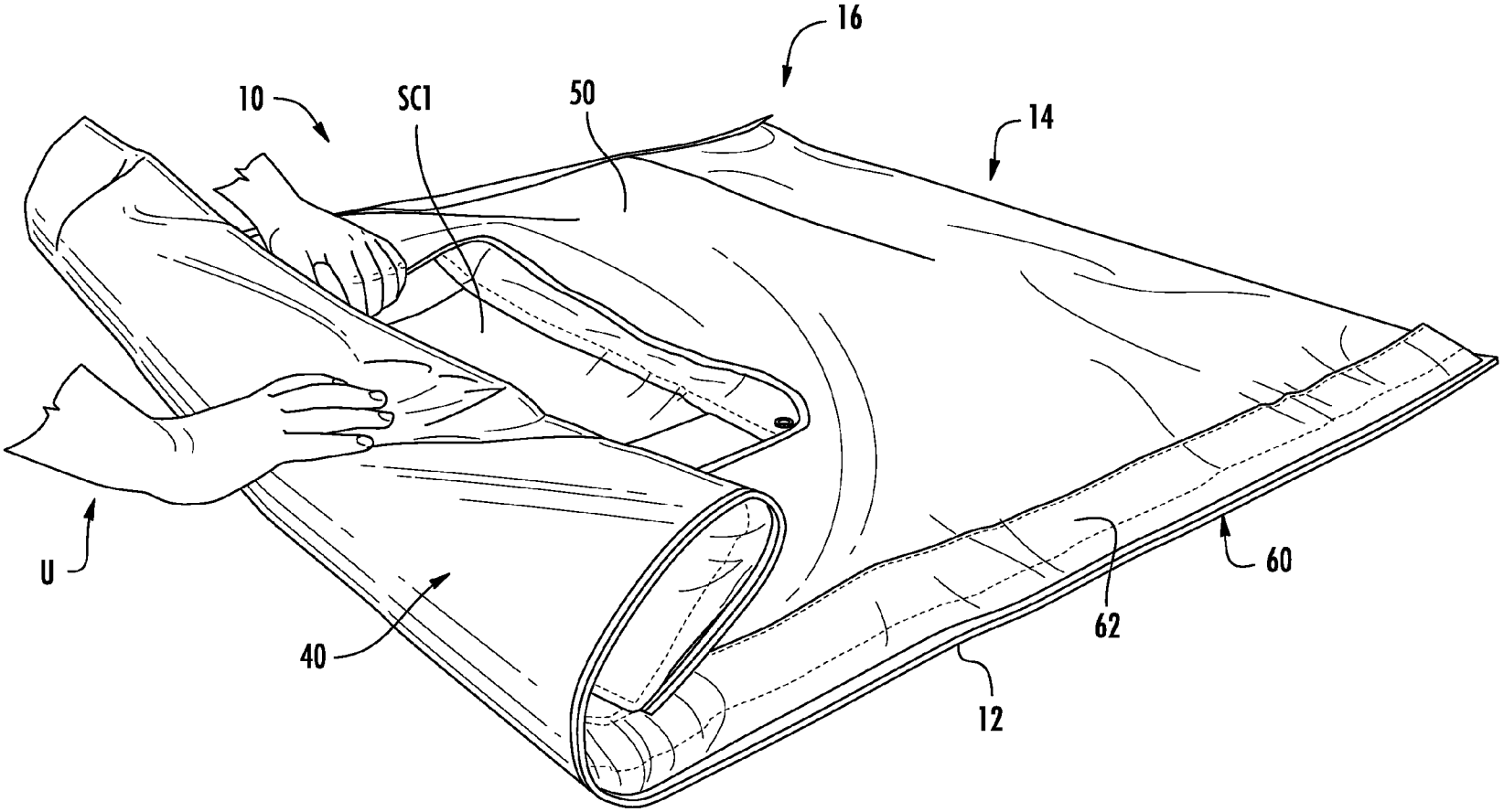
FIG. 13 is a perspective view of stowage apparatus illustrated in FIG. 6 according to another method step.
Figure 14:
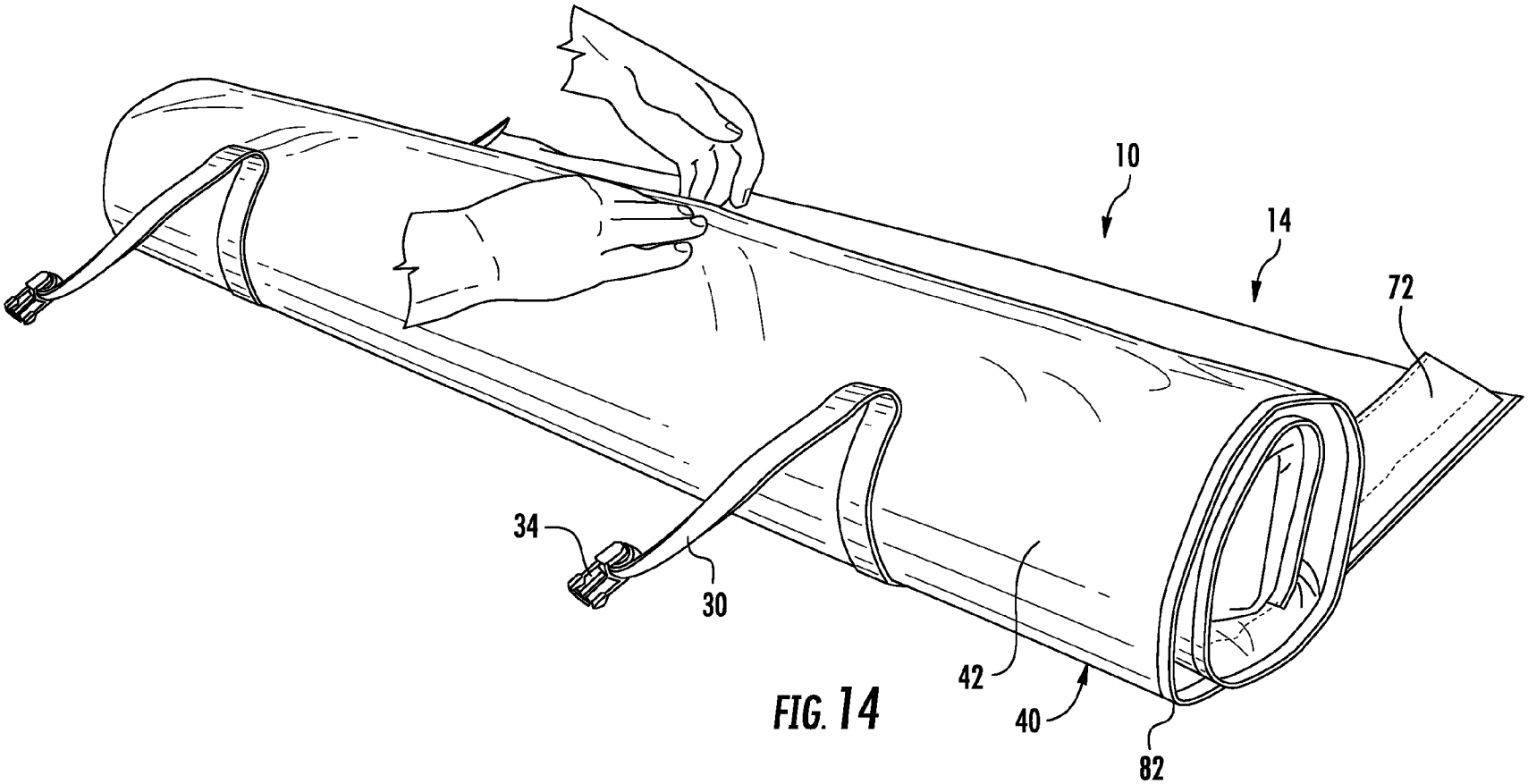
FIG. 14 is a perspective view of stowage apparatus illustrated in FIG. 6 according to another method step.

With reference to FIG. 13, a second fold is made by the user U by folding a portion of the base layer 40 over another portion of the top layer 50 while tucking the first folded portion under the second folded portion, thereby continuing the rolling process. The rolling is continued until a generally tubular structure is achieved with the base layer rolled from the open end 16 to the closed end 14 as seen in FIG. 14.

Figure 15:
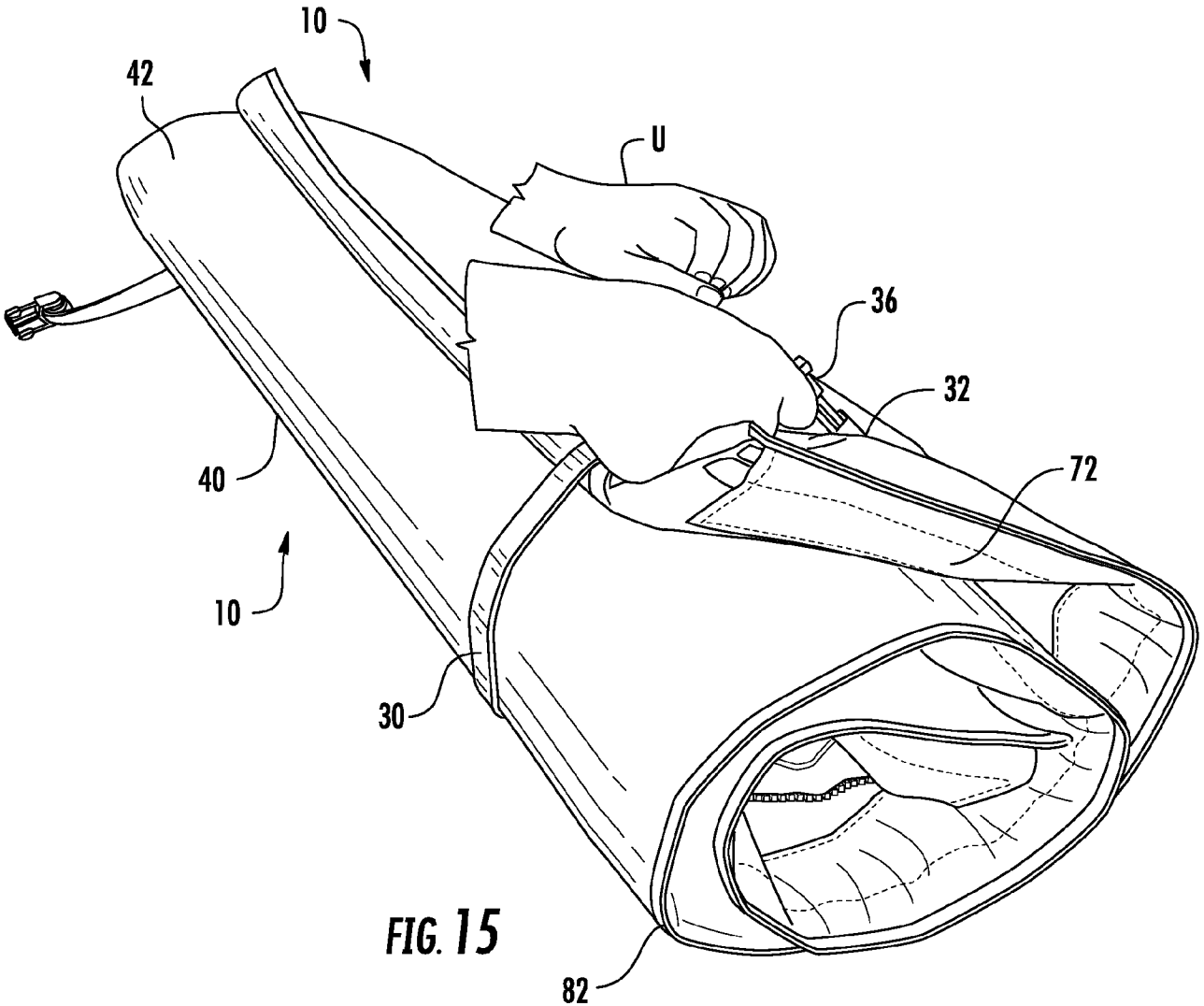
FIG. 15 is a perspective view of stowage apparatus illustrated in FIG. 6 according to another method step.
Figure 16:
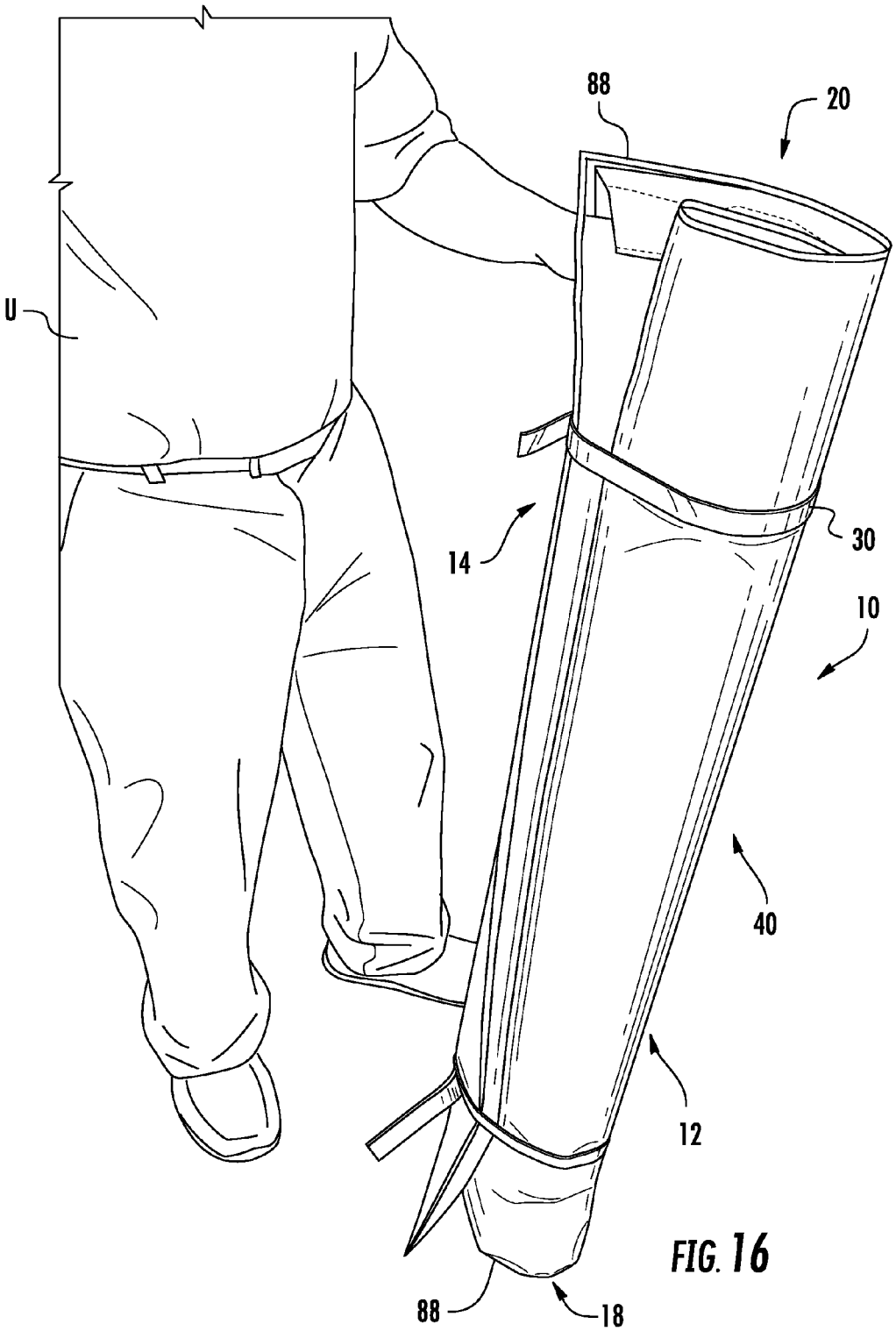
FIG. 16 is a perspective view of stowage apparatus illustrated in FIG. 6 according to another method step.

Turning to FIG. 15, the first and second buckles 34, 36 are engaged by the user U in order to join the straps, 30, 32 on either end of the rolled stowage apparatus as seen in FIG. 15.

As may be appreciated, the process of reconfiguring the present apparatus 10 from a planar flat structure into a rolled, cylindrical structure includes repeated folding, tucking and rolling until the ends of the straps 30, 32 carrying the buckles 34, 36 may be attached to one another.

Preferably, the stowage apparatus 10 can be itself stowed on the boat or location in a vertically-oriented manner with either of the selvages 86, 88 on a support surface with the body 12 of the apparatus 10 extending upwardly in a vertical orientation thereby, minimizing exposure of the side curtains to any deck overwash or abrasive surfaces.

By the above, the present invention provides an apparatus for stowing one or more marine side curtain that protects the transparent window portions with a non-abrasive material over the entire surface thereof while providing a structure that is easily loaded and reconfigured from a loading disposition to a stowage condition thereby protecting the side curtains until needed for further marine use.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

We claim:

1. A marine side curtain stowage apparatus for stowing pliant marine side curtains in sheet form, the side curtains having a transparent portion for throughvision, the stowage apparatus comprising:

a pliant external base layer having an outer weather surface and an uninterrupted inner surface, the inner surface being formed from a nonabrasive material for abutting contact with the transparent portion of a side curtain across the entire uninterrupted inner surface, the base layer forming the entire outer weather surface of the apparatus;

a pliant internal top layer having an uninterrupted surface formed from a nonabrasive material for abutting contact with the transparent portion of a side curtain across the entire uninterrupted surface wherein the base layer and the top layer each include a first side edge, a second side edge, a first end edge and a second end edge with the base layer and the top layer joined along respective first end edges, wherein the base layer and the top layer are coextensive;

a first fastening element operatively associated with the base layer and the top layer for releaseably joining the first side edge of the base layer with the first side edge of the top layer; and a second fastening element associated with the base layer and the top layer for releaseably joining the second side edge of the base layer with the second side edge of the top layer;

wherein the base layer and the top layer are thereby configured to selectively cover with abutting contact the transparent portion of a side curtain, sealable against weather along respective side edges thereof and pliant for rolling into a generally cylindrical configuration for stowage of marine side curtains.

2. A marine side curtain stowage apparatus according to claim 1 and further comprising a pliant intermediate layer extending between the top layer and the bottom layer and joined to the top layer and the bottom layer at the first end edges of the top layer and the bottom layer, the intermediate layer formed from a nonabrasive material and having a first inner surface and a second inner surface, wherein multiple marine side curtains can be stowed with one marine side curtain between the base layer and the intermediate layer and one marine side curtain between the top layer and the intermediate layer.

3. A marine side curtain stowage apparatus according to claim 1 and further comprising a plurality of pliant intermediate layers extending between the top layer and the bottom layer, the intermediate layers being formed from a nonabrasive material and having an outer surface and an inner surface, wherein multiple marine side curtains can be stowed with one marine side curtain between the base layer and one of the plurality of intermediate layers, one marine side curtain between the top layer another of the plurality of intermediate layers and one marine side curtain between two of the plurality of intermediate layers.

4. A marine side curtain stowage apparatus according to claim 1 wherein the base layer extends beyond the top layer defining an extended layer portion along the first side edge of the base layer, wherein the extended layer portion includes a flap having a first portion of the first fastening element attached thereto for being folded over the top layer and fastenable thereto using a second portion of the first fastening element.

5. A marine side curtain stowage apparatus according to claim 4 wherein the first fastener element includes a hook-and-loop fastener.

6. A marine side curtain stowage apparatus according to claim 1 wherein the base layer extends beyond the top layer defining an extended layer portion along a second side edge of the base layer, wherein the extended layer portion includes a flap having a first portion of the second fastening element attached thereto for being folded over the top layer and fastenable thereto using a second portion of the second fastening element.

7. A marine side curtain stowage apparatus according to claim 6 wherein the second fastener element includes a hook-and-loop fastener.

8. A marine side curtain stowage apparatus according to claim 5 wherein a first portion of the hook-and-loop fastener extends uninterrupted along a full length of the first side edge of one of the base layer and the top layer, and the second portion of the hook-and-loop fastener extends uninterrupted along a full length of the first side edge of the other of the base layer and the top layer.

9. A marine side curtain stowage apparatus according to claim 7 wherein a first portion of the hook-and-loop fastener extends uninterrupted along a full length of the second side edge of one of the base layer and the top layer, and the second portion of the hook-and-loop fastener extends uninterrupted along a full length of the second side edge of the other of the base layer and the top layer.

10. A marine side curtain stowage apparatus according to claim 1 wherein the outer weather surface of the base layer includes a fastening arrangement for retaining the stowage apparatus in a rolled condition.

11. A marine side curtain stowage apparatus according to claim 4 wherein the fastening arrangement includes at least one strap attached to the outer weather surface, the strap having a first end and a second end, and a buckle arrangement with a first buckle element attached to a one strap end and a second buckle arrangement attached to a second strap end, wherein the first buckle element is selectively matable with the second buckle element when the stowage apparatus is in a rolled condition.

12. A marine side curtain stowage apparatus according to claim 1 wherein the base layer and the top layer are formed from a single continuous sheet folded to form the base layer and the top layer.

13. A marine side curtain stowage apparatus according to claim 1 wherein the nonabrasive material includes a contact surface for contact with the transparent portion of the window wherein the contact surface includes a plurality of indentations to resist adhesion of the transparent portion of the window and the nonabrasive material contact surface.

14. A marine side curtain stowage apparatus according to claim 1 and further comprising a selvage formed with each side edge and projecting away therefrom thereby providing a support base on which the stowage apparatus can stand upright when rolled while retaining the stowed window elements in a covered condition wherein relative movement between the transparent portion of the window and the nonabrasive material contact surface is prevented.

15. A marine side curtain stowage apparatus for stowing pliant marine side curtains in sheet form, the side curtains having a transparent portion for throughvision, the stowage apparatus comprising:

a pliant external base layer having an outer weather surface and an uninterrupted inner surface, the inner surface being formed from a nonabrasive material for abutting contact with the transparent portion of a side curtain across the entire uninterrupted inner surface, the base layer forming the entire outer weather surface of the apparatus;

a pliant internal top layer having an uninterrupted surface formed from a nonabrasive material for abutting contact with the entire transparent portion of a side curtain across the entire uninterrupted surface wherein the base layer and the top layer each include a first side edge, a second side edge, a first end edge and a second end edge with the base layer and the top layer joined along respective first end edges, wherein the base layer and the top layer are coextensive;

at least one pliant intermediate layer extending between the top layer and the bottom layer, the intermediate layer formed from a nonabrasive material and having an outer surface and an inner surface, wherein multiple marine side curtains can be stowed with one marine side curtain between the base layer and the intermediate layer and one marine side curtain between the top layer and the intermediate layer;

wherein the base layer, the top layer and the intermediate layer are joined along respective first end edges thereof throughout the extent of the respective first end edges;

a first fastening element operatively associated with the base layer and the top layer for releaseably joining the first side edge of the base layer with the first side edge of the top layer; and a second fastening element associated with the base layer and the top layer for releaseably joining the second side edge of the base layer with the second side edge of the top layer;

wherein the base layer extends beyond the top layer defining an extended layer portion along at least one side edge of the base layer, wherein the extended layer portion includes a flap having the second fastening element attached thereto for being folded over the top layer and fastenable thereto using the first fastening element and the second fastening element;

wherein multiple marine side curtains can be stowed with one marine side curtain between the base layer and the intermediate layer and one marine side curtain between the top layer and the intermediate layer; and wherein the base layer and the top layer are thereby configured to selectively cover with abutting contact the entire transparent portion of a side curtain, sealable against weather along respective side edges thereof and pliant for rolling into a generally cylindrical configuration for stowage of marine side curtains.

* * * * *